US005516471A

United States Patent [19]

Sands et al.

[11] Patent Number: 5,516,471

[45] Date of Patent: May 14, 1996

[54] METHOD OF FORMING A DECK ASSEMBLY FOR AN EXERCISE TREADMILL

[75] Inventors: Mark D. Sands, Centralia; Daniel A. Schwandt, Bothell; Soddy Tsang, Seattle; Wes A. Williams, Arlington, all of Wash.

[73] Assignee: Precor Incorporated, Bothell, Wash.

[21] Appl. No.: 413,912

[22] Filed: Mar. 30, 1995

Related U.S. Application Data

[63] Continuation of Ser. No. 919,134, Jul. 23, 1992, abandoned.

[51] Int. Cl.[6] ..... B29C 43/02; B29C 43/20

[52] U.S. Cl. ..... 264/112; 264/109; 264/115; 264/122

[58] Field of Search ..... 156/65.2; 264/109, 264/122, 118, 115, 112

[56] References Cited

U.S. PATENT DOCUMENTS

| | | | |
|---|---|---|---|
| 2,031,973 | 2/1936 | Mudge | 99/12 |
| 2,581,652 | 1/1952 | Goss | 264/115 |
| 2,960,423 | 11/1960 | Kreibaum | 264/115 |
| 3,165,567 | 1/1965 | Olson | 264/255 |
| 3,293,336 | 12/1966 | Himmelheber | 264/109 |
| 3,580,736 | 5/1971 | Moyer et al. | 117/155 |
| 3,703,284 | 11/1972 | Hesen | 272/69 |
| 3,791,856 | 2/1974 | Duling et al. | 117/155 UA |
| 3,844,829 | 10/1974 | Black | 117/155 L |
| 3,847,637 | 11/1974 | Luszczak | 106/271 |
| 3,874,971 | 4/1975 | Black et al. | 156/308 |
| 3,969,459 | 7/1976 | Fremont | 264/109 |
| 4,024,014 | 5/1977 | Akerson | 162/145 |
| 4,148,857 | 4/1979 | Wheeler | 264/87 |
| 4,496,718 | 1/1985 | Rudy | 264/109 |
| 4,503,115 | 3/1985 | Hemels et al. | 264/112 |
| 4,602,779 | 7/1986 | Ogden | 272/69 |
| 4,616,822 | 10/1986 | Trulaske et al. | 272/69 |
| 4,643,860 | 2/1987 | Knudson et al. | 264/109 |
| 4,872,664 | 10/1989 | Parker | 272/69 |
| 4,940,741 | 7/1990 | De Wacker et al. | 524/47 |
| 5,059,264 | 10/1991 | Sheets | 156/62.2 |

*Primary Examiner*—Allan R. Kuhns
*Attorney, Agent, or Firm*—Christensen, O'Connor, Johnson & Kindness

[57] ABSTRACT

A treadmill having a belt and deck with a relatively long, useful lifetime is disclosed. The belt of this assembly has a tread layer formed of PVC plastic or other material that serves as the layer of the belt upon which a person actually steps, and a fabric layer. The fabric layer has weft threads that extend laterally across the belt and that are substantially embedded in the plastic material and warp threads that extend longitudinally along the belt that have exposed sections that extend outside of the plastic material. The fabric layer is woven so that the exposed sections of the warp threads are equal to at least 50% of their overall length. The deck of this treadmill is formed with a plywood substrate and a wax-embedded hardboard. The substrate provides structural support for the hardboard and the persons using this treadmill. The hardboard serves as the surface along which the belt rides when a person steps on the treadmill.

11 Claims, 5 Drawing Sheets

METHOD OF FORMING A DECK ASSEMBLY FOR AN EXERCISE TREADMILL

This application is a continuation application based on prior application Ser. No. 07/919,134, filed on Jul. 23, 1992, now abandoned.

FIELD OF THE INVENTION

This invention is related generally to treadmills and, more particularly, to a belt and deck assembly for a treadmill.

BACKGROUND OF THE INVENTION

Treadmills are used to provide individuals with walking or running exercise, physical therapy, or as a diagnostic tool. A typical treadmill has an elongate flat frame on which an endless belt is mounted for movement over the frame. A motor attached to the base rotates the belt to require the person on the belt to walk or run at a pace equal to the rate at which the belt moves. Typically a flat deck is disposed underneath the belt. When the person on the treadmill places a foot down, the underlying, bottom, surface of the belt presses against the top of the treadmill deck. A treadmill is designed so that, when a section of its belt is stepped on, the belt will continue to move over the surface of the deck.

A disadvantage of many current treadmills is that their belts and decks wear out at a rapid rate. Each time the belt and deck come into contact, a relatively high-friction interface is formed. The inherent scrubbing action of this contact that occurs as a result of the belt being dragged along the deck, as well as the friction-generated heat that develops along the interface between these two components, serves to incrementally wear off the material from which the belt and deck are formed. Over time, so much of the material forming the belt and deck is worn away that either one or both components become unusable and need to be replaced. The rate at which treadmill belts and decks need to be replaced in health clubs and like locations is especially rapid because in these locations the treadmills are typically in high use.

There have been numerous attempts to increase the useful lifetime of treadmill belts and decks. Most of these efforts have centered around reducing the friction of the belt-deck interface. U.S. Pat. No. 3,659,845, for example, discloses a treadmill with a wax-embedded section of canvas secured to the to the top surface of the deck, the surface against which the belt presses. U.S. Pat. No. 3,703,284 discloses a treadmill with a polytetrafluorethylene/fluorocarbon (Teflon)-coated deck. U.S. Pat. Nos. 4,602,779, 4,616,822, and 4,872,664 disclose treadmill decks that have been built from other low-friction material, formed of material that conduct the heat generated at the belt-deck interface into the surrounding environment, and/or provided with an outer coating of wax,. While these efforts have served to reduce some of the wear to which a treadmill belt and complementary deck are exposed, they have not been entirely successful in significantly increasing the useful life of these components.

SUMMARY OF THE INVENTION

This invention is related to a treadmill belt and deck assembly. More particularly, this invention is related to a treadmill belt and deck assembly that are not prone to rapidly wear out and that have a relatively long useful lifetime. This invention is also related to a method of fabricating a treadmill deck.

The treadmill deck of this invention includes a belt with a fabric bottom layer and a deck with a wax-embedded hardboard layer. The belt of this invention is composed of separate layers. A top layer forms the tread of the belt and functions as the surface on which the person actually steps when using the treadmill. An intermediate layer functions as the tension layer. A bottom layer is in the form of a woven fabric. This layer is partially embedded in the overlying tension layer. In one preferred embodiment of the invention, the individual threads of the bottom fabric layer are formed of multiple polyester filaments. The belt is assembled so that the weft threads, the threads that extend across the belt, are all substantially, if not completely, embedded in the overlying material that forms the tension layer. The only sections of the warp threads, the threads that extend the length of the belt, that are embedded in the tension layer are the sections of the threads that cross under the weft threads when the belt is viewed from the bottom. The threads are woven in a pattern such that for every weft thread a warp thread crosses under, it crosses over two or more weft threads. Consequently, the exposed sections of the warp threads have a length equal to at least 50% of their overall length.

The deck of this treadmill assembly includes a wax-embedded hardboard layer and a plywood substrate. The hardboard layer functions as the actual surface of the deck over which the belt travels. The substrate provides structural support for the hardboard and for the person standing on the treadmill. In one preferred embodiment of the invention, a wax such as a polyethylene wax is embedded in the hardboard during its manufacture. One particular method of manufacturing the hardboard of this invention involves initially grinding up wood into small particles called fines. Wax and resin are added to the fines and the mixture is dried to a cake-like consistency. The fine mixture is then broken up and placed on a caul, the platen of a press. The wax is then added to the fine mixture. The fine mixture is then subjected to a high-temperature (approximately 365° F.), high-pressure (approximately 900 psi) press process to form the final hardboard product. After the press process, the hardboard is glued to the plywood substrate.

When the treadmill of this invention is assembled, the fabric layer of the belt is located adjacent the hardboard portion of the deck. When a person steps on the belt, the longitudinally extending warp threads are the primary elements of the belt that are disposed against the wax-embedded hardboard. The coefficient of friction between the warp threads and the hardboard is relatively low. Consequently, only a minimal amount of friction-generated heat is developed. Moreover, since the wax is embedded through the entire thickness of the hardboard, the continual use of the treadmill will not result in the development of a wax-free interface between deck surface and the treadmill belt. Thus, even with extended use, the belt-deck coefficient of friction remains relatively low. Furthermore, even with the extended use of the treadmill, the warp threads remain secured to the belt. Consequently, neither the belt or deck of the treadmill assembly of this invention experience appreciable wear, even when the treadmill is subjected to prolonged periods of use.

BRIEF DESCRIPTION OF THE DRAWINGS

This invention will be pointed out with particularity in the appended claims. The above and further advantages of the invention may be better understood by reference to the following detailed description, taken in conjunction with the accompanying drawings, in which:

DETAILED DESCRIPTION OF THE PREFERRED EMBODIMENT

Figure 1:
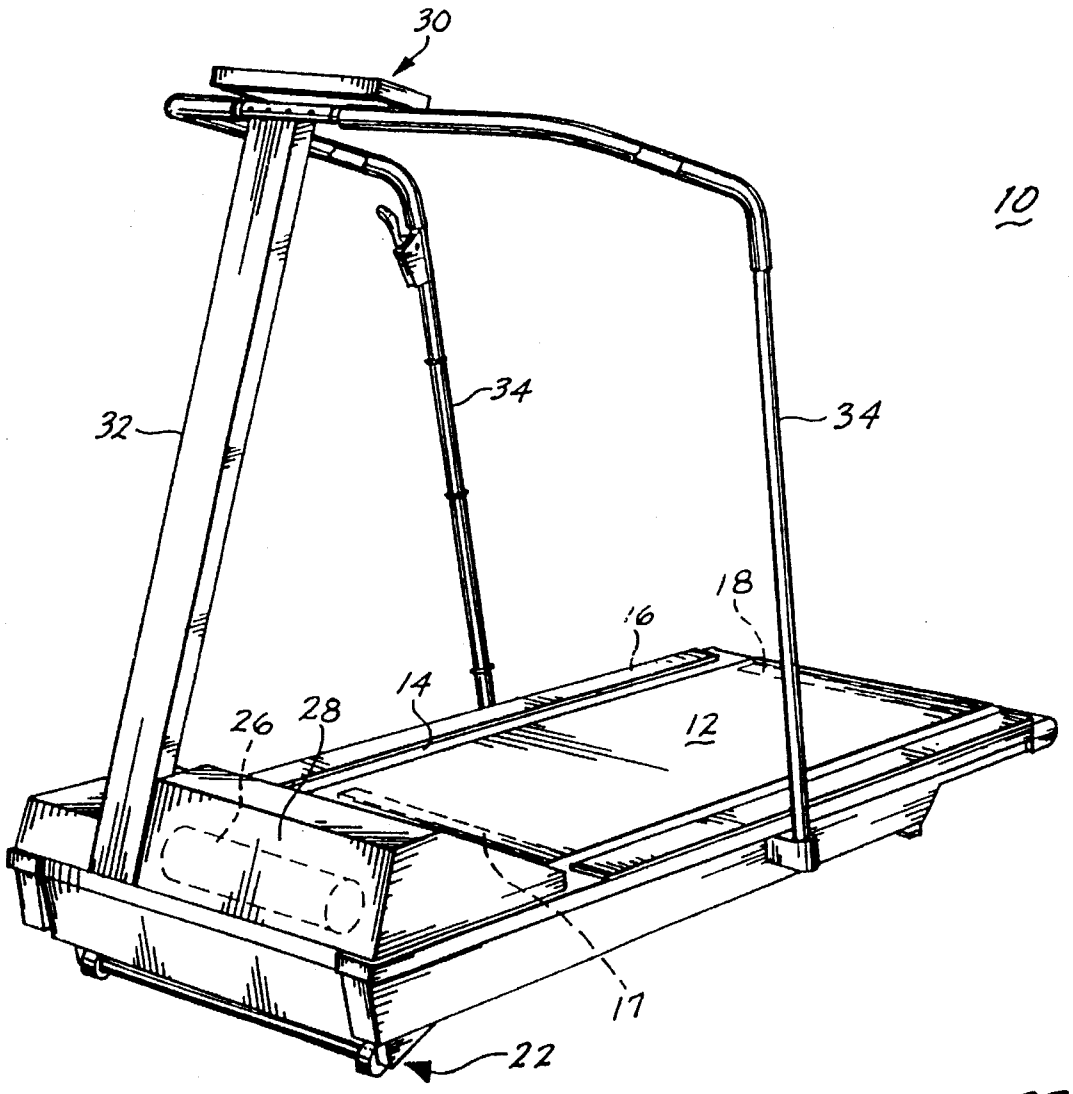
FIG. 1 depicts a treadmill assembly that includes the belt and deck of this invention.

Initially referring to FIG. 1, a powered apparatus in the form of an exercise treadmill 10 that includes the belt 12 and deck 14 of this invention is illustrated. The exercise treadmill 10 includes a main frame structure 16 on which is mounted the endless belt 12 trained over a forward a drive roller 17 and a rearward driven or idler roller 18 (rollers shown in phantom) both axled on the main frame. The deck 14 is secured to the frame 16 so as to closely underlie and support the upper run of the endless belt 12. A subframe 22 is pivotally mounted n the forward portion of the main frame 16 adjacent the front of the deck 14 to pivot or shift relative to the main frame about the transverse access about which the drive roller 18 is powered. The orientation of the subframe 22 relative to the main frame 16 is alterable through a linear actuator (not illustrated) which may be controlled while standing on the treadmill deck 14 to raise and lower the forward end of the main frame 16 to simulate incline or hill.

An electric motor 26 (shown in phantom) is mounted on the subframe 22 to power the forward drive roller 18. The electric motor 26 and other components are covered by a hood 28. A display assembly 30 is mounted on a forward post 32 extending upward from the front of the treadmill 10. A microprocessor, not shown, is housed within the display assembly 30 to calculate and display various workout parameters, including, for instance, elapsed time, speed, distance traveled, and the angle or percent of incline of the treadmill. A handrail structure 34 extends upward from both sides of the main frame 16, longitudinally forward and then laterally across the front portion of the treadmill display adjacent the top of the post 32 and beneath the display assembly 30.

Figure 2:
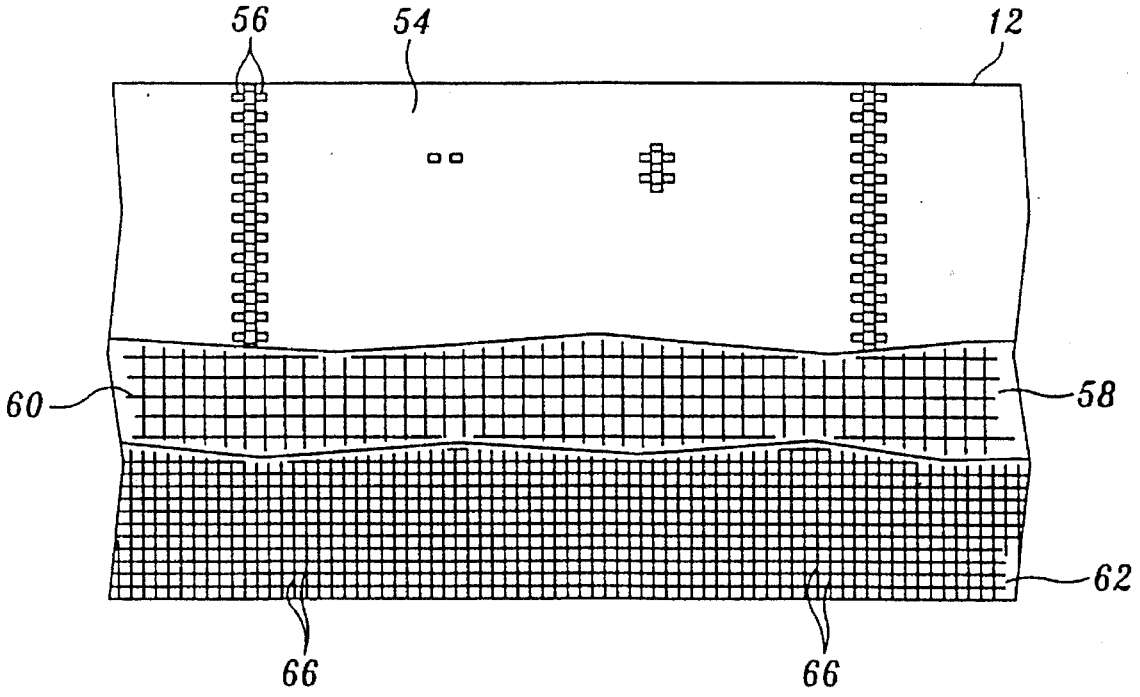
FIG. 2 is a cutaway plan view of the belt of the treadmill assembly of this invention.

The belt 12, as depicted in FIG. 2, is formed of three separate layers. A top layer 54 is composed of a PVC plastic and functions as the tread upon which a person using the treadmill 10 actually steps. This layer is approximately 3 to 8 mm thick and is formed with patterned bumps 56 that serve as the tread surface. Below the tread layer 54 is a tension layer 58 formed of polyester. The polyester forming the tension layer is approximately 2 mm thick. Embedded in the tension layer is a grid 60 formed of a mono-filament polyester thread. The material from which the layers 54 and 58 are composed is flexible enough to be repeatedly rotated about the treadmill rollers 24 and 30 without cracking. A fabric layer 62 forms the third, bottom layer of the belt 12.

In one preferred version of this treadmill 10, the fabric layer 62 is formed from a multi-filament polyester thread. The belt 12 is assembled so that the fabric layer 62 is partially embedded into the adjacent tension layer 58 such that the weft threads 64, the threads that extend laterally across the belt, are substantially, if not completely, embedded in the tension layer. The fabric layer 62 is further constructed so that the warp threads, the threads that extend longitudinally along the belt, have embedded sections that extend under the weft threads 64 (when viewed from the bottom of the belt) that are embedded in the tension layer 58 and exposed sections that cross over the weft threads and over the outer surface i.e. (the bottom surface when viewed from the bottom of the belt) of the tension layer.

In one version of the present invention, the weft threads 66 are approximately 0.03 inch apart from each other and the warp threads are approximately 0.01 inch apart from each other. Since the threads have a diameter of approximately 0.01 inch, the exposed sections of the adjacent warp threads 66 contact each other. The thread is woven so that the exposed sections of the warp threads 66 have a length equal to at least 50% of their overall length. In other words, when viewed from the bottom of the belt 12, the exposed sections of the warp threads 66 are greater than the sections of the warp threads embedded in the tension layer 58 with the weft threads 64.

Figure 3:
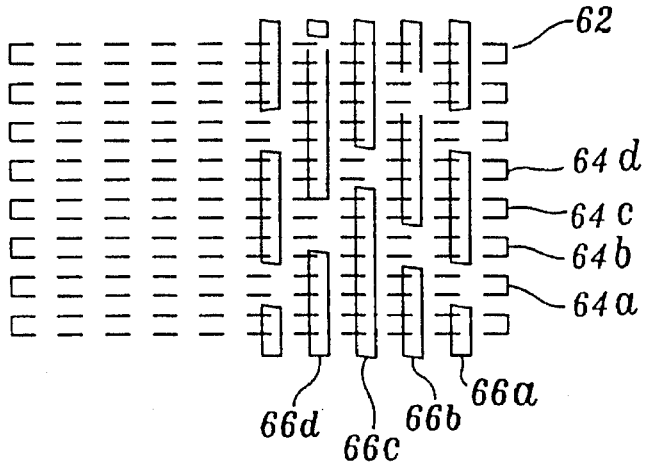
FIG. 3 is a diagrammatic illustration of the weave pattern of the fabric layer of the belt assembly of this invention when viewed from the bottom of the belt.

FIG. 3 diagrammatically illustrates one particular weave pattern of the fabric layer 62 when viewed from the bottom of the belt. In this FIGURE, the weft threads 64 are shown in phantom to represent that they are embedded in the tension layer 58. It can further be seen that each warp thread 66 crosses over three weft threads 64 for each weft thread that it crosses under. The warp threads 66 are further arranged in groups of four wherein their lateral position in the group determines which particular weft thread they cross under. As seen in FIG. 3, warp threads $\mathbf{66}_a$–$\mathbf{66}_d$, arranged right to left in the FIGURE, each cross over a different one of the weft threads $\mathbf{64}_a$–$\mathbf{64}_d$, which extend upwards from the bottom of the FIGURE. Warp thread $\mathbf{66}_a$ crosses under weft thread $\mathbf{64}_a$. The next warp thread, thread $\mathbf{66}_b$, crosses over the next weft thread, thread $\mathbf{64}_b$. The next warp thread, thread $\mathbf{66}_c$, crosses under the weft thread two up from the last weft thread; it crosses under weft thread $\mathbf{64}_d$. The last warp thread, thread $\mathbf{66}_d$, crosses over the uncrossed weft thread $\mathbf{64}_c$, the weft thread one down from the last warp thread, thread $\mathbf{66}_c$, which was crossed under. In this particular version of the invention, the exposed sections of the warp threads are equal to approximately 70% of the overall thread length.

Figure 4:
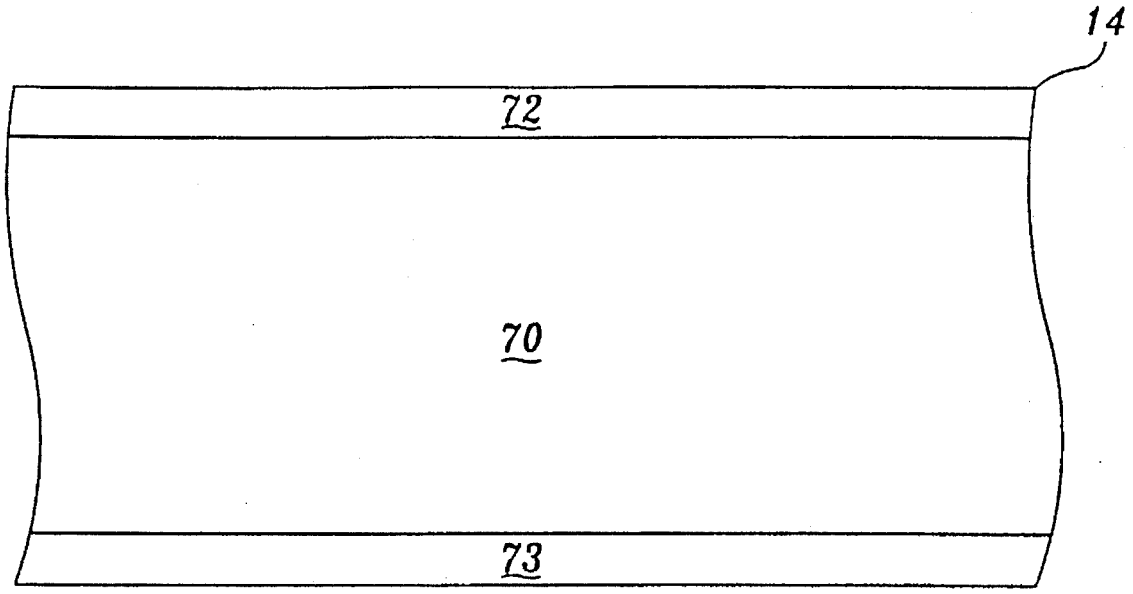
FIG. 4 is a cross-sectional view of the treadmill deck of this invention.

The treadmill deck 14, as seen in FIG. 4, includes a plywood substrate 70 to which a wax-embedded hardboard 72 is bonded. The hardboard functions as the outer member of the deck 14, the surface of the deck 14 over which the belt 12 rides. The plywood substrate 70 provides structural support for the hardboard 72 and persons using the treadmill 10. The substrate 70 is the portion of the deck 14 that is actually attached to the frame 16 (FIG. 1). In many preferred embodiments of the invention, a second hardboard layer 73 is attached to the bottom of the plywood substrate 70. After the first hardboard 72 becomes worn, the deck 14 can then be inverted so the unused hardboard 73 is positioned on the top of the deck 14. In some preferred versions of the invention, the substrate 70 is about ¾-inch thick and the hardboards 72 and 73 are each about ⅛-inch thick.

Figure 5:
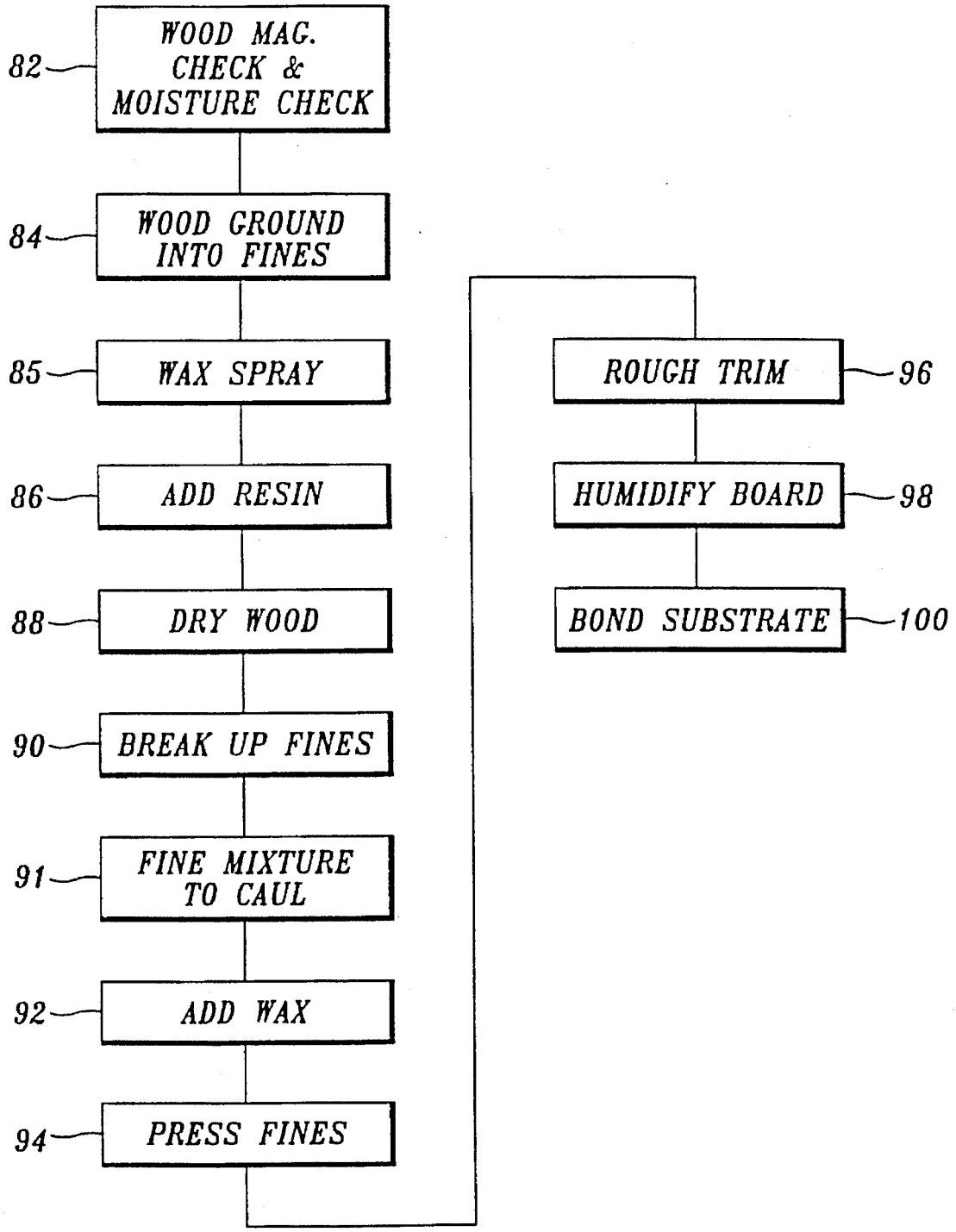
FIG. 5 is a flow diagram of the process used to manufacture the hardboard portion of the treadmill deck of this invention.

The deck hardboard 72 is manufactured according to the steps depicted in FIG. 5. Initially, the raw wood from which the hardboard is manufactured, such as Douglas fir, is subjected to inspection for the presence of magnetic materials (metals) and a moisture check as represented by step 82. It is desirable that the wood have a moisture content of about 50% by weight. If the moisture content is higher than desired, wood with a lower moisture content is added in order to reduce the overall moisture content of the wood. If the moisture content is lower than desired, the moisture content is increased by adding wood with a higher moisture content. Wood that passes inspection and is of acceptable moisture content is ground into fines, represented by step 84, by well-known methods. Fines are wood particles that are approximately 0.00625 inch×0.00625 inch×0.0125 inch in size. The grinding of the wood into fines is considered the first step in the wood-refining process.

After the wood is ground into fines, it is subjected to a wax spray step 85 wherein a water-based wax, such as Borden's Casco Wax Type No. EWH 403H, is applied to the fines. In some preferred embodiments of the invention, the amount of wax added to the wood is approximately 0.5% the total weight of the wood. The wax is added to the fines to retard moisture buildup. In the next step 86, a resin is added to the fines to bond the fines together during the curing process described more fully below. In some preferred versions of the invention a phenolic resin, such as Georgia Pacific's phenolic resin Type No. GP-2301 is added to the fines wherein the weight of the resin is equal to approximately 3% of the overall weight of wood.

The wood is then subjected to a drying process, represented by step 88, wherein it is dried in a Heil dryer until its moisture content is between approximately 6% to 9% its overall weight. One selected method of measuring the moisture content of the wood involves weighing a sample of wood and then placing it in a 400° F. oven for 10 minutes. The baked sample is then weighed. The difference in weight between the two samples is used to calculate the moisture content of the wood. The drying of the wood forms what is referred to as a fine mixture and completes the wood-refining process.

After the refining process, the fine mixture is subjected to a feltering process which begins with the breaking up of the fine mixture chunks as represented by step 90. In step 91 the fine mixture is placed on a caul, which serves as a press platen. The fine mixture is layered on or skimmed off the caul so that it is approximately 2.5 inches thick. Next in step 92, a wax such as a polyethylene wax with a molecular weight of approximately 1000 is added to the fine mixture. One suitable wax that can be added to the wood material is a polyethylene wax marketed under the name Polywax 1000 by the Petrolite Corporation of Kilgore, Tex. This wax does not include any hazardous ingredients, in solid form is white in color, has little odor associated with it, is of negligible volatility, is not soluble in water, has a specific gravity of approximately 0.95 at 60° F., and a flash point greater than 350° F. Generally approximately 20 to 120 grams of wax are applied per square foot of the boards for a total of about 3 to 7 pounds of wax. For treadmills 10 of this invention built for home use, it may only be necessary to add approximately 20 to 70 grams of wax per square foot board. In versions of the invention built for use in health clubs and in other locations where the treadmills are subjected to relatively constant use, it may be desirable to add approximately 70 to 120 grams of wax per square foot of board to the fine mixture chunks. The wax is added to the caked wood material by a conventional spreader that is located above the caul. The addition of the wax completes the hardboard feltering process.

After the feltering process, the fine mixture is cured under pressure and temperature as depicted by step 94. In the press step 94, the wood is pressed to form the hardboard 72. The pressing step involves applying about 900 psi of pressure to the fines while they are heated to a temperature between 300° F. and 400° F. In a preferred version of the invention, the fines are heated to approximately 365° F. The press cycle may extend for approximately 3 to 4 minutes and, more particularly, approximately about 3.7 minutes.

After pressing, the hardboard is subjected to a rough trimming step 96 wherein the board is cut to approximately 50"×100" size. The board is then humidified to a level of about 7% to 9% by weight as represented by step 98. This step involves placing the board in a humidifier in which the interior temperature is approximately 125° F. and the relative humidity is approximately 98%. The board is held in the humidifier approximately 8 hours. The hardboard 72 is then attached to the plywood substrate 70 as depicted by step 100. One preferred method of securing the hardboard 72 to the substrate is to apply an adhesive such as a compounded polyvinyl acetate emulsion between the hardboard and the substrate and then allow the adhesive to cure under pressure. A suitable adhesive is the Weldbond Universal adhesive manufactured by Frank T. Ross and Sons Ltd. of West Hill, Ontario. The large substrate-hardboard subassembly, is then cut to deck size and holes are drilled to facilitate its mounting to the treadmill 10.

When the treadmill 10 of this invention is assembled, the belt fabric layer 62 is located adjacent the exposed top surface of the deck hardboard 72. Whenever a person using the treadmill places a foot down on the belt 12, the fabric layer 62 rubs against the hardboard 72. Owing to the nature of the threads 64 and 66 forming the fabric layer 62 and the wax contained in the hardboard 72, the coefficient of friction between the belt 12 and deck 14 is relatively low. For example, a treadmill 10 of this invention with a new deck and belt has been found a measured coefficient of friction of approximately 0.22. Thus, only a minimal amount of heat develops as a consequence of the belt being dragged along the deck during foot plant. Moreover, it is believed that as persons use the treadmill, the pressure on the deck 14 will cause wax to wick up to the surface of the deck and/or that the inevitable scrubbing away of the surface of the deck will also expose more wax. The increase of wax on the surface of the deck should reduce the deck-belt coefficient of friction from that of the initial, new, state of the treadmill 10 so as to cause a likewise reduction in heat generation during foot plant.

The arrangement of the threads 64 and 66 forming the fabric layer 62 is believed to contribute to the relatively long life of this assembly. The exposed sections of the warp threads 66, which are equal to at least half of their overall length, function as the primary interface between the belt and the deck. These are the threads that are oriented to travel in the direction of the belt movement. Consequently, prolonged use of the treadmill 10 does not cause these threads to wear appreciably, preventing them from becoming frayed and break as in conventional treadmills. This prevents the adjacent tension layer 58 from becoming exposed to the surface of the deck 14 which, in turn, can cause a relatively high-friction interface to develop between the belt and the deck. Moreover, since the entire thickness of the deck hardboard 72 is embedded with wax, even as the hardboard becomes worn, wax will always be present at the interface between the hardboard and belt to maintain low-friction therebetween and to minimize the wear of both components. Thus, both the belt 12 and deck 14 of the treadmill 10 of this invention have a relatively long useful life.

Figure 6:
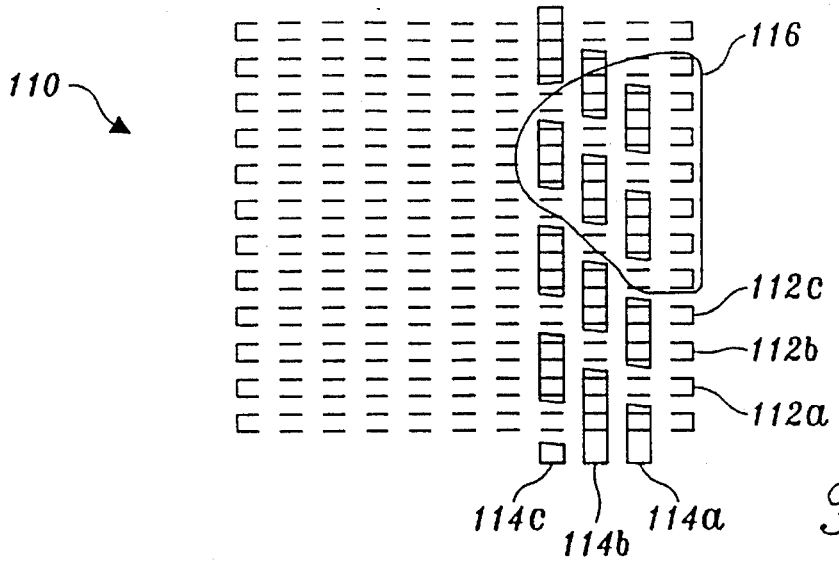
FIG. 6 is a diagrammatic illustration of the weave pattern of an alternative fabric layer of the belt assembly of this invention when viewed from the bottom of the belt.

FIG. 6 is a diagrammatic illustration of the weave pattern of an alternative fabric layer 110 that may be suitable for incorporation into the belt 12 of the treadmill 10 of this invention. Fabric layer 110 is formed out of weft threads 112 and warp threads 114 that are woven in a pattern so that each warp thread 114 crosses over two weft threads 112 before crossing under a single weft thread that is embedded in the tension layer 58 (FIG. 2). When three warp threads, threads $\mathbf{114}_a$, $\mathbf{114}_b$, and $\mathbf{114}_c$ and three weft threads, threads $\mathbf{112}_a$, $\mathbf{112}_b$, and $\mathbf{112}_c$ are viewed, it can be observed that warp thread 114*a* crosses under weft thread $\mathbf{112}_a$. Warp thread $\mathbf{114}_b$, which is to the left of warp thread $\mathbf{114}_a$, crosses under weft thread $\mathbf{112}_b$ which is one up from warp thread $\mathbf{112}_a$. Warp thread $\mathbf{114}_c$, which is to the left of warp thread $\mathbf{114}_b$, crosses under weft thread $\mathbf{112}_c$, which is one up from weft thread $\mathbf{112}_b$. It is believed that an advantage of this fabric layer is that since the exposed length of the warp threads 114 is reduced, though still at least 50% of the overall thread length, is that threads will only have a engage in a minimal amount of lateral shifting or wiggle. The minimization of this movement reduces the amount breakage-inducing stress to which the warp threads 114 would otherwise be exposed. This serves to further increase the overall lifetime of the belt 12 and deck 14 of the treadmill.

The movement of the exposed portion of the warp threads 114 may be further limited by the application of a thin coating of a protective plastic 116, such as thermoplastic urethane, over the bottom surface of the belt 12, (coating partially represented in FIG. 6). In some preferred versions of the invention the coating 116 is at the most about 0.001 inches thick and extends over the whole of the surface of the belt 12 that rubs against the deck 14. The coating 116 serves to hold the exposed portions of the warp threads 114 in place so as to further reduce their movement and the stress to which they would otherwise be exposed. Coating 116 also serves as a barrier to prevent dirt, and other foreign substances, from working into the threads 114 so as to stress them.

Figure 7:
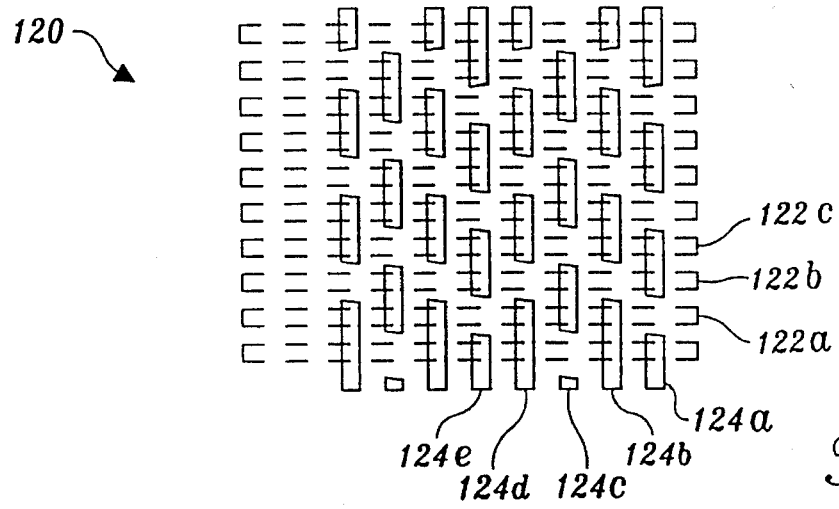
FIG. 7 is a diagrammatic illustration of the weave pattern of a second alternative fabric layer of the belt assembly of this invention when viewed from the bottom of the belt.
Figure 8:
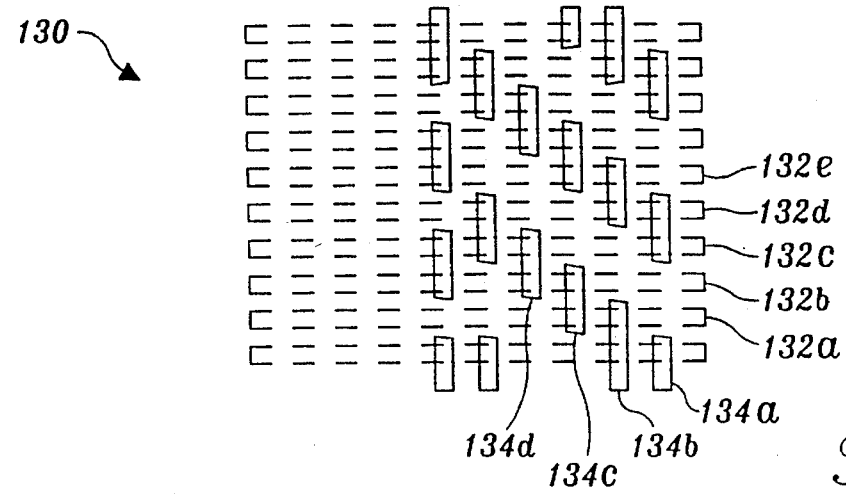
FIG. 8 is a diagrammatic illustration of the weave pattern of a third alternative fabric layer of the belt assembly of this invention when viewed from the bottom of the belt.

Alternative fabric layers 120 and 130, diagrammatically depicted by FIGS. 7 and 8 respectively, can also be incorporated into the belt 12 of this treadmill 10. Fabric layer 120 is composed of weft threads 122 and warp threads 124 that are arranged so that each warp thread crosses over two weft threads and then crosses under a single welt thread that is embedded in the adjacent tension layer 58 (FIG. 2). Fabric layer 120 is woven in what can generally be viewed as a sawtooth pattern. As seen in FIG. 7, a first warp thread, thread $\mathbf{124}_a$, crosses under a first weft thread, thread $\mathbf{122}_a$; adjacent warp threads $\mathbf{124}_b$ and $\mathbf{124}_c$ cross under the adjacent weft threads $\mathbf{122}_b$ and $\mathbf{122}_c$, respectively. Then, the next warp thread, thread $\mathbf{124}_d$ crosses under weft thread $\mathbf{122}_b$, the same thread under which warp thread $\mathbf{124}_b$ crossed. The following warp thread, thread $\mathbf{124}_e$, crosses under the same weft thread, thread $\mathbf{122}_a$, under which thread $\mathbf{124}_a$ crosses to repeat the cycle. It is believed that weave pattern of fabric layer 120 serves to both reduce the lateral movement of the exposed portions of the warp threads 120 and to reduce the cost of forming the fabric layer.

Fabric layer 130 (FIG. 8) is formed out of weft threads 132 and warp threads 134 that are arranged so that each warp thread crosses over two weft threads and then crosses under two weft threads that are embedded in the adjacent tension layer 58 (FIG. 2). The threads are woven such that a first warp thread, thread $\mathbf{134}_a$, crosses under two weft threads, threads $\mathbf{132}_a$ and $\mathbf{132}_b$. Warp thread $\mathbf{134}_b$, the thread immediately to the left of thread $\mathbf{134}_a$, crosses under weft threads $\mathbf{132}_b$ and $\mathbf{132}_c$. Warp thread $\mathbf{134}_c$, the thread immediately to the left of thread $\mathbf{134}_b$, crosses under weft threads $\mathbf{132}_c$ and $\mathbf{132}_d$. Warp thread $\mathbf{134}_d$, the thread immediately to the left of thread $\mathbf{134}_c$, crosses under weft threads $\mathbf{134}_d$ and $\mathbf{134}_e$. It is believed an advantage of this weave pattern is that it minimizes the lateral movement of the exposed portions of the warp threads 134 and thus the stress to which they would otherwise be exposed. FIG. 8 also illustrates that some versions of the invention will be understood to have exposed warp thread sections equal to at least one-half of the overall thread length by virtue of the fact that the fabric layer is woven so that each warp thread crosses over at least one weft thread for every weft thread that it crosses under.

It will be understood that the foregoing description is for the purposes of illustration only. It will be readily recognized that the treadmill assembly of this invention can be practiced with alternative components other than those described by way of the example above. For example, there is no requirement that each and every belt 12 of this invention be formed with a fabric layer having polyester threads. Fabric layers having weave patterns different from what have been disclosed may be employed. Furthermore, it should be understood that in some versions of the invention it may be possible to space the weft threads 64 sufficiently apart from each other so that with even a 1:1 crossover ratio the exposed sections of the warp threads are equal to at least or greater than 50% of their overall lengths. It should also be understood that in some versions of the invention the exposed sections of the warp threads may be 70 to 80% of their overall length. Flexible material other than PVC plastic, for example, a rubber compound, may be used to form the belt tread and tension layers 54 and 58 respectively. Also, in some versions of the invention, the tread layer and the tension layer may be formed out of a single layer of flexible material. The coating 116 may be applied to other versions of the invention than ones employing the fabric layer 110 of FIG. 7. Also it may be desirable to apply the coating to only a section of the belt.

It should similarly be understood that alternative constructions of the deck 14 of this invention are possible. For instance, it may be desirable to provide a deck formed entirely of a wax-embedded hardboard that does not include a plywood substrate. It should also be understood that other waxes may be embedded in the substrate than the one described and that other methods of manufacturing the hardboard may be employed. Therefore, it is the object of the appended claims to cover all such modifications and variations as come within the true spirit and scope of the invention.

The embodiments of the invention in which an exclusive property or privilege is claimed are defined as follows:

1. A method of making hardboard for use as a low friction surface in exercise equipment, which comprises the steps of:

providing wood fines;

adding resin to the fines;

adjusting the moisture content of the fines after adding the resin;

mixing wax with the fines after adjusting the moisture content of the fines, said wax being in an amount of at least 96 grams of wax per cubic foot of the fines to form a mixture that is homogeneous therethrough in order to facilitate continued low friction qualities even as the hardboard is worn down; and after mixing wax with the fines, pressing the mixture together under high temperature and high pressure to form the hardboard.

2. The method of making hardboard according to claim 1, wherein said mixture is pressed at approximately 900 psi and at approximately 300°–400° F.

3. The method of making hardboard according to claim 2, wherein said mixture is pressed together at a temperature of approximately 365° F.

4. The method of making hardboard according to claim 1, wherein during the step of adjusting the moisture content of the fines, the moisture content of the fines is adjusted to an amount in the range of approximately 6% to 9%.

5. The method of making hardboard according to claim 4, wherein a polyethylene wax is added to said mixture in an amount of at least about 5.9% of the mixture by weight.

6. The method of making hardboard according to claim 1, wherein a polyethylene wax is added to said mixture in an amount of about 200 to 576 grams of wax per cubic foot of the mixture.

7. A method of making an exercise equipment treadmill deck having a low friction surface against which a treadmill belt bears, the method for which comprises:

providing wood fines each having a size of generally about 1/160-inch by 1/160-inch by 1/80-inch;

adding resin to the fines;

adjusting the moisture content of the fines;

adding wax to the fines in an amount of at least 20 grams of wax per about 0.75 pounds of the combination of resin and fines; and after adding wax to the fines, pressing the fines together under high temperature to form the treadmill deck.

8. The method of making a treadmill deck according to claim 7, wherein polyethylene wax is used.

9. The method of making a treadmill deck according to claim 8, further including the step of securing a substrate to one side of said deck.

10. A method of making exercise equipment hardboard, the hardboard having a thickness and a low friction contact surface usable for interfacing with a sliding member adapted to slide over the contact surface, the method for which comprises:

providing wood fines that are similar in size to wood sawdust;

mixing wax with the wood fines in an amount of about 5.9% or more of the hardboard by weight wherein the wax is sufficiently embedded throughout the thickness of the hardboard to create a relatively low friction interface between the contact surface of the hardboard and the sliding member that continues even as the hardboard is worn down by the sliding member; and after mixing the wax with the wood particles, pressing the wood particles together under high temperature and high pressure to form the hardboard.

11. A method of making hardboard comprising the steps of:

providing wood particles;

adding a first wax to the wood particles;

adding resin to the wood particles;

drying the wood particles after adding the first wax and the resin to the wood particles;

adding a second wax to the wood particles after drying the wood particles; and after adding the second wax to the wood particles, pressing the wood particles together under high temperature to form the hardboard.

* * * * *